United States Patent [19]

Sohmiya et al.

[11] Patent Number: 5,038,175

[45] Date of Patent: Aug. 6, 1991

[54] IMAGE DENSITY CONTROL METHOD

[75] Inventors: Norimasa Sohmiya, Soka; Yasushi Koichi, Yamato; Kazunori Karasawa, Tokyo, all of Japan

[73] Assignee: Ricoh Company, Tokyo, Japan

[21] Appl. No.: 530,291

[22] Filed: May 30, 1990

[30] Foreign Application Priority Data

| | | | |
|---|---|---|---|
| May 30, 1989 | [JP] | Japan | 1-136634 |
| May 31, 1989 | [JP] | Japan | 1-137803 |
| Aug. 16, 1989 | [JP] | Japan | 1-211059 |
| Feb. 26, 1990 | [JP] | Japan | 2-45116 |

[51] Int. Cl.[5] ..... G03G 21/00

[52] U.S. Cl. ..... 355/246; 355/204; 355/214

[58] Field of Search ..... 355/214, 246, 245, 204, 355/208; 118/688, 689

[56] References Cited

U.S. PATENT DOCUMENTS

| | | | |
|---|---|---|---|
| 4,416,535 | 11/1983 | Tottori | 355/246 |
| 4,468,112 | 8/1984 | Suzuki | 355/246 |
| 4,572,102 | 2/1986 | Yuge et al. | 118/689 |
| 4,758,861 | 7/1988 | Nakamaru | 355/246 |

FOREIGN PATENT DOCUMENTS

| | | | |
|---|---|---|---|
| 00050080 | 2/1989 | Japan | 355/204 |

*Primary Examiner*—A. T. Grimley
*Assistant Examiner*—Patrick J. Stanzione
*Attorney, Agent, or Firm*—Oblon, Spivak, McClelland, Maier & Neustadt

[57] ABSTRACT

A method of controlling the density of images produced by an electrophotographic image forming apparatus to a constant value. A toner density sensor is provided with a first reference level variable in response to the output of an image density sensor, and a second reference level representative of a state associated with the optimum condition of a developer (e.g. immediately after replacement thereof). During usual control, the toner concentration of the developer is detected on the basis of the output of the toner density sensor, and the toner supply to the developer is controlled on the basis of the result of comparison of the detected toner concentration and the first reference level.

5 Claims, 7 Drawing Sheets

POWER SWITCH ON
S1
REFERENCE VALUE SET MODE
NO
C
YES
SET KEY ON
S2
S3
KEY ON
NO
YES
CANCEL Vo2
S4
S5
DEVELOPING ROLLER MOTOR ON
DETECT Vr
S6
DETECT Vo1
S7
S8
Vo1 = Vr
NO
CANCEL Vo1 BY 1 STEP
S9
YES
S10
DEVELOPING ROLLER MOTOR ON
DETECT Vo2
S11
S12
Vo2 = Vo1
NO
CHANGE Vo2 ONE STEP
S13
YES
LOCK 1ST LEVEL Vo2
S14
DISPLAY Vo2
S15
DISPLAY Vo1
S16
B

IMAGE DENSITY CONTROL METHOD

BACKGROUND OF THE INVENTION

The present invention relates to a method of controlling the density of images produced by an electrophotographic image forming apparatus to a constant value.

Generally, an image forming apparatus implemented by an electrophotographic procedure such as an electrophotographic copier uses a photoconductive element having a photoconductive surface thereof. While a document is illuminated, a reflection from the document is focused onto the photoconductive element to electrostatically form a latent image representative of the document. A toner is electrostatically deposited on the latent image to produce a toner image. The toner image is transferred to a paper sheet or similar medium to complete a desired reproduction or copy. In this type of copier, stabilizing image density is one of most important conditions for insuring high image quality. Some different approaches have heretofore been proposed to stabilize image quality, as follows.

A first approach consists in forming a latent image of a reference density pattern, i.e., a black image having a reference density on a photoconductive element, sensing the amount of toner deposited on the latent image in terms of a reflectance by using an image density sensor (sometimes referred to as a P sensor hereinafter), comparing the resulted output of the sensor with a reference output representative of the reference density, and controlling the amount of toner to be supplied to a developer stored in a developing device in response to the result of comparison. A second approach is such that an electrometer detects the potential of a latent image formed on a photoconductive element and representative of a reference density pattern, and the charging, exposing and developing bias conditions are so controlled as to bring the potential to a predetermined adequate level. A third approach is practicable with a two-component developer which is a mixture of a toner and a carrier. Specifically, the third approach executes a sequence of steps of detecting the fluidity of the developer by a toner density sensor (sometimes referred to as an F sensor), determining the proportion of the toner and the carrier on the basis of the detected fluidity of the developer, and controlling the toner density in matching relation to the determined proportion.

The first to third conventional approaches outlined above have various problems left unsolved. Regarding the first approach, assume that the charge potential is lowered due to the fatigue of the photoconductive element, that the charge on the photoconductive element is locally disturbed by the deterioration of a charger or similar cause, or that the amount of light for illumination is not uniform due to the contamination and deterioration of optics used to form the latent image of the reference density pattern. Then, such an occurrence would be included in the control over the toner supply and would thereby cause an excessive amount of toner to be supplied to the developer. For example, when the charge deposited on the photoconductive element is made lower in an area where the latent image of the reference density pattern is to be formed than the other area due to local contamination of the charger, the detected density of the resultant toner image is lower than the actual density. As a result, the toner concentration of the developer is noticeably increased from the ordinary concentration, causing the toner to scatter around. Conversely, when the toner is not accurately supplied to the developer, the proportion of the carrier to the toner increases and, hence, the carrier is apt to mechanically to damage the photoconductive element by rubbing itself against the latter.

The second approach successfully stabilizes the potential of the latent image formed on the photoconductive element, but it has the following drawbacks. Specifically, assuming that the photoconductive element has been deteriorated due to fatigue, compensating the degradation of the charging characteristic ascribable to the fatigue by controlling the charging condition often lowers the optical sensitivity of the photoconductive element. Further, when the developing bias condition is controlled to control the image density, the contamination of the background on the photoconductive element and the image density act in a contrary relationship and thereby degrade the image quality, although an adequate developing potential may be achieved in the event of development.

Regarding the third approach, as the developer is deteriorated due to aging, for example, the amount of fatigued toner particles which do not contribute to development at all increases in the developer. This, coupled with the fact that the charging characteristic which is determined by the amount of charge deposited on the toner varies depending on the ambient conditions, makes it impractical to determine the image quality in terms of the toner concentration of the developer. It follows that the toner concentration of the developer which directly affects the image quality cannot be fixed. Further, it is difficult to achieve stable images because the amount of charge on the toner changes, as stated above. In addition, the third approach cannot adapt itself to the variation of the photoconductive element.

The first to third approaches stated above may be suitably combined to eliminate their drawbacks, as has been proposed. Specifically, the image density sensor or P sensor and the toner density sensor or F sensor particular to the first and third approaches, respectively, may be combined, as disclosed in Japanese Patent Laid-Open Publication (Kokai) No. 136667/1982 by way of example. Then, the control level (reference value) of the F sensor will be automatically changed in response to an output signal of the P sensor so as to control the image density. This kind of scheme provides images with stable density by compensating for the drawbacks particular to the individual sensors.

However, in the combination of P and F sensors, the reference value of the F sensor is unconditionally changed in response to the output of the P sensor. It is likely, therefore that when the characteristic of the developer is changed due to a change in temperature, humidity or similar ambient condition or when a particular kind of document image is used, the reference value of the F sensor greatly differs from the actual detected level. Specifically, the characteristics (density, amount of charge, and so forth) of the developer and photoconductive element are apt to vary temporarily over a substantial range when temperature, humidity or similar ambient condition sharply changes or depending on the conditions of use. If the P sensor senses the reflectance under such a condition, the reference value of the F sensor will be changed more than necessary or sharply. Then, the toner would be supplied to the developer abruptly in a great amount to increase the toner concentration or would not be supplied at all over a long period of time to reduce the toner concentration. This brings about various problems such as the scattering of toner particles, the abrupt change in the image density, and the damage to the developer. Another drawback with the prior art method is that since the F sensor is provided with a single reference value. Specifically, if the single reference value has been changed, a serviceman cannot see the degree to which the developer has been deteriorated at the time of inspection and, therefore, cannot predict the adequate time for maintenance. Since the upper and lower limits of developer density are determined beforehand machine by machine and cannot be changed later, it is impracticable to change them in matching relation to the developer at the time of replacement of the developer, for example, or to change them for compensating for irregularities among machines. For the reasons described above, it often occurs that the developer is replaced before it is deteriorated or is not replaced at all even after the deterioration.

SUMMARY OF THE INVENTION

It is therefore an object of the present invention to provide an image density control method for an image forming apparatus which eliminates the drawbacks particular to the prior art as discussed above.

It is another object of the present invention to provide an image density control method for an image forming apparatus which facilitates the decision on the condition of use and the deterioration of a developer and informs a person of the time for developer replacement adequately.

It is another object of the present invention to provide an image density control method for an image forming apparatus which suppresses various kinds of undesirable occurrences ascribable to a sharp change in the characteristic of a developer.

It is another object of the present invention to provide a generally improved image density control method for an image forming apparatus.

In an electrophotographic image forming apparatus which forms a predetermined image on a medium by electrostatically forming a latent image on a photoconductive element, electrostatically depositing a toner contained in a developer on the latent image to produce a toner image, and transferring the toner image to the medium, an image density control method of the present invention comprises the steps of providing a first sensor for sensing a toner concentration of the developer, and a second sensor for sensing a density of a toner image produced by developing a latent image of a reference density pattern formed on the photoconductive element, providing a first reference level and a second reference level, wherein the first reference level is variable in response to the second reference level and a result of detection outputted by the second sensor, and the second reference level is set machine by machine, and controlling, during image density control, supply of the toner to the developer by comparing with the first reference level a detected level associated with a toner concentration of the developer detected by the first sensor, whereby an image density is maintained constant by the toner concentration of the developer.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
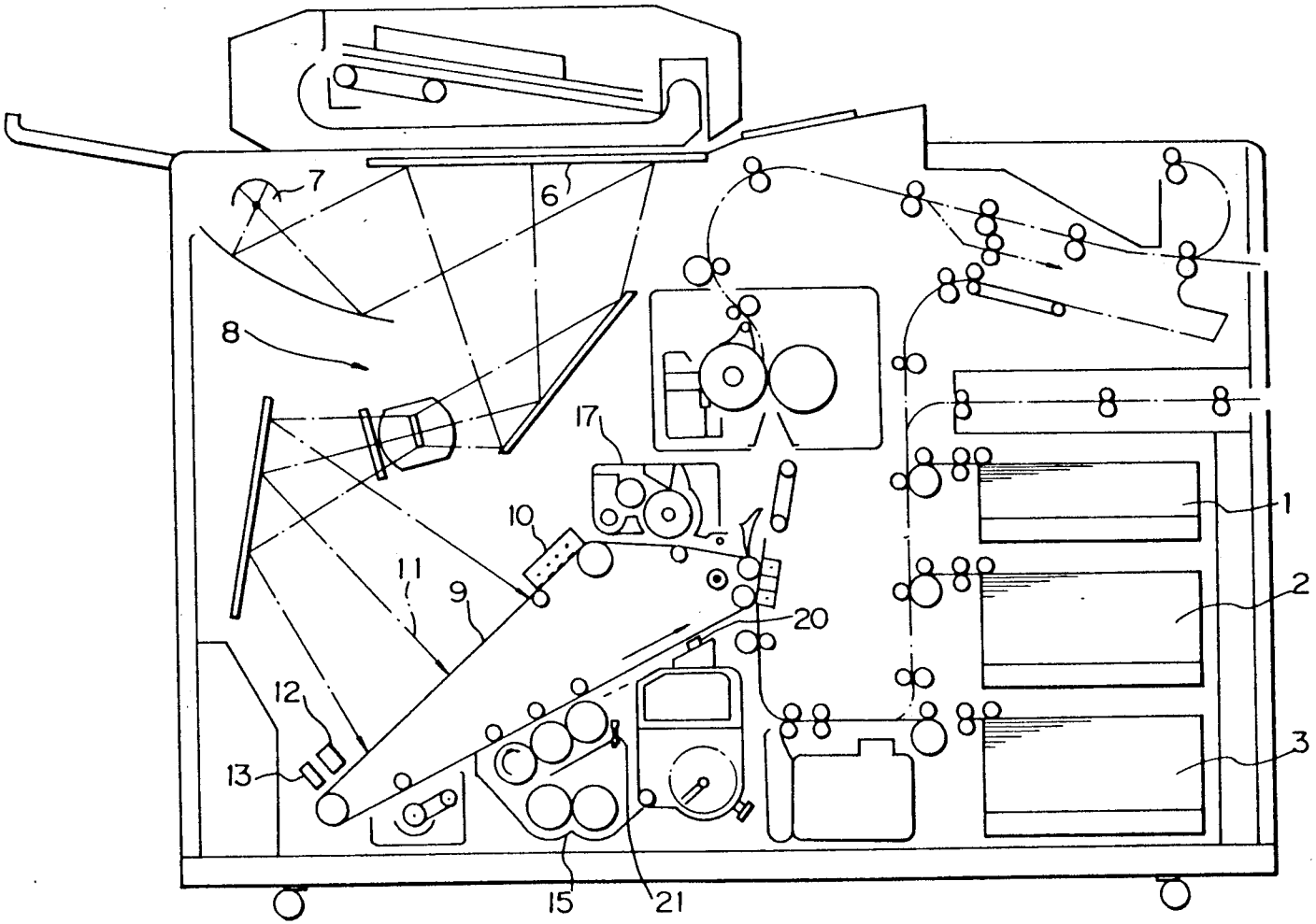
FIG. 1 is a schematic view of a copier representative of an image forming apparatus to which an image density control method of the present invention is applicable.

Referring to FIG. 1 of the drawings, a copier belonging to a family of image forming apparatuses to which the present invention is applicable is shown. As shown, the copier includes a photoconductive element in the form of a belt 9 which is passed over a plurality of drive pulleys and driven in a direction indicated by an arrow. As the belt 9 starts moving, a charger 10 uniformly charges the surface of the belt 9. An exposing device scans a document which is laid on a glass platen 6 and focuses the resultant reflection from the document onto the charged surface of the belt 9, whereby a latent image representative of the document is electrostatically formed on the belt 9. Specifically, the exposing device has a light source 7, and optics 8 which includes mirrors and a lens. The light source 7 illuminates the document and a black and white pattern which is provided on the underside of the glass platen 6. The black and white pattern has a black and a white portion each of which has a particular reference density and a particular reflectance. A reflection 11 from the document is focused onto the belt 9 to form a latent image thereon. Provided on the glass platen 6 outside of a document loading range, the white portion and black portions of the pattern have densities of, for example, 0.04 and 0.80 (halftone), respectively. A latent image representative of such a reference density pattern is achievable by varying the charging condition of the charger 10 until the latent image corresponding to the halftone density reaches a predetermined potential.

After the imagewise exposure, the area of the belt 9 other than the latent image forming area is discharged by an eraser 13. The erasure by the eraser 13 also occurs except for a predetermined number of successive copying cycles as counted from the time when the power switch or the copier is turned on, or when the predetermined potential is not reached. After the belt 9 has been discharged by the eraser 13, a developing device 15 develops the latent images by a black toner, for example. An image density sensor or P sensor 20 senses the densities of the reference density pattern developed on the belt 9. The developed image representative of the document is transferred to a paper sheet which is fed from any one of paper trays 1, 2 and 3. After the image transfer, a cleaning device 17 removes toner particles remaining on the belt 9 to prepare the belt 9 for another copying process. The developing device 15 has a developer container loaded with a two-component developer which may be the mixture of black toner and carrier. A developing roller incorporated in the developing device 15 supplies the developer to the belt 9, while a toner supply roller also incorporated in the device 15 supplies a toner from a toner storing section to the developer container.

The copier has a structure for sensing the densities of images formed on the belt 9. Specifically, a potential sensor in the form of an electrometer 12 is located ahead of the eraser 13 with respect to the moving direction of the belt 9 and adjacent to the surface of the belt 9 which is to be exposed. The potential sensor 12 is responsive to the potential of a latent image formed on the belt 9. The previously mentioned image density sensor or P sensor 20 is also located to face the surface of the belt 9 which is to be exposed, and is responsive to the amount of toner deposited on the belt 9 by the developing device 15. Further, a toner density sensor or F sensor 21 is disposed in the developing device 15 for sensing the concentration of toner in the developer stored in the device 15 in terms of the fluidity of the developer. This sensor 21 is used to control the density of the developer in the developing device 15.

Figure 2:
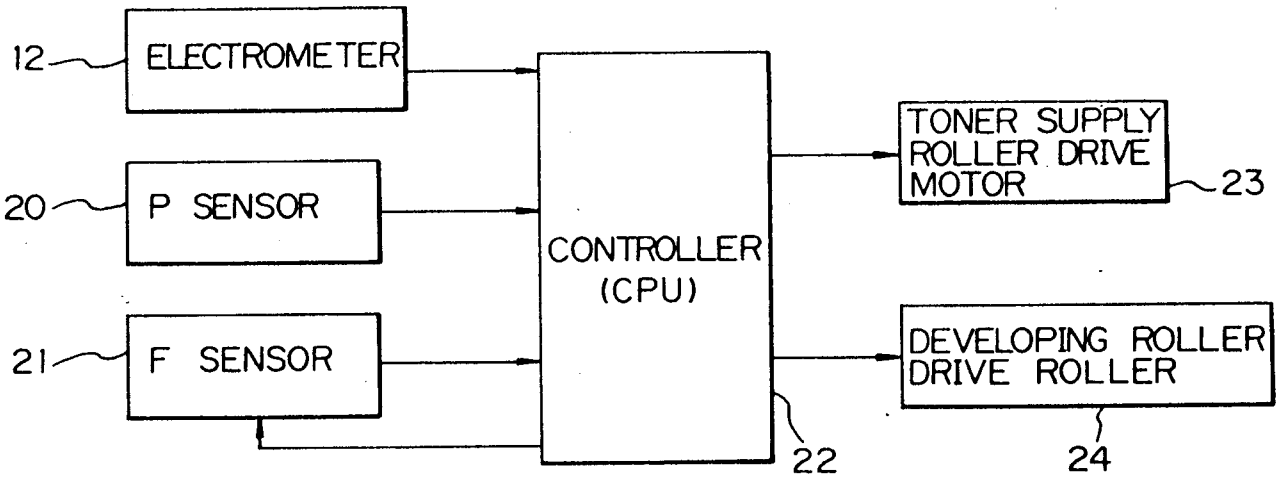
FIG. 2 is a block diagram schematically showing an image density control system of the copier of FIG. 1.
Figure 3:
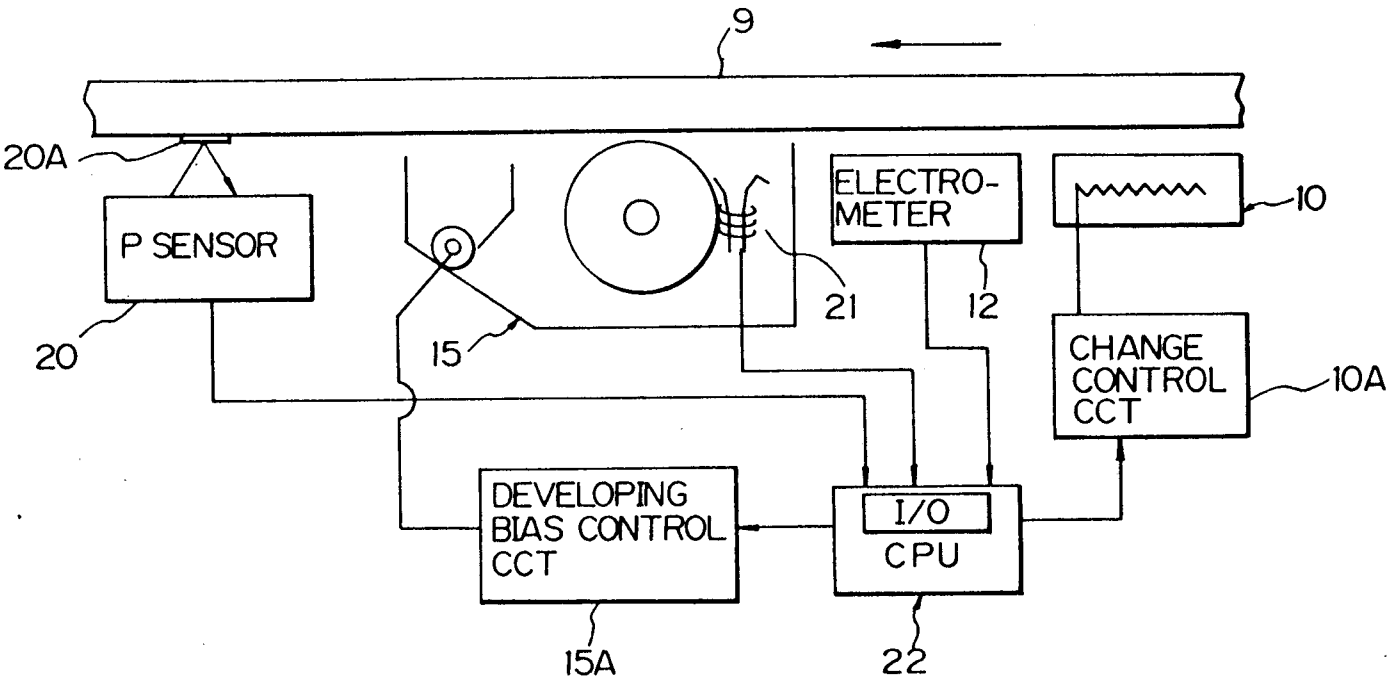
FIG. 3 is a fragmentary view representative of the image density control system shown in FIG. 2.

As shown in FIGS. 2 and 3, the sensors 12, 20 and 21 stated above are interconnected to a controller (CPU) 22 of the copier via an I/O (Input/Output) section. The controller 22 is built in a control unit incorporated in the copier body and implemented by a microcomputer. The sensors 12, 20 and 21 are interconnected to the input ports of the I/O section, while other various components including the charger 10 and motors 23 and 24 are interconnected to the output ports of the I/O section. The motor 23 drives the toner supply rollers of the developing device, while the motor 24 drives the developing roller and others of the developing device. Also shown in FIG. 3 are a reference density pattern 20A, a developing bias control circuit 15A, and a charge control circuit 10A.

A specific operation of the copier for controlling the image density will be described with reference to FIGS. 4A and 4B.

Figure 4A:
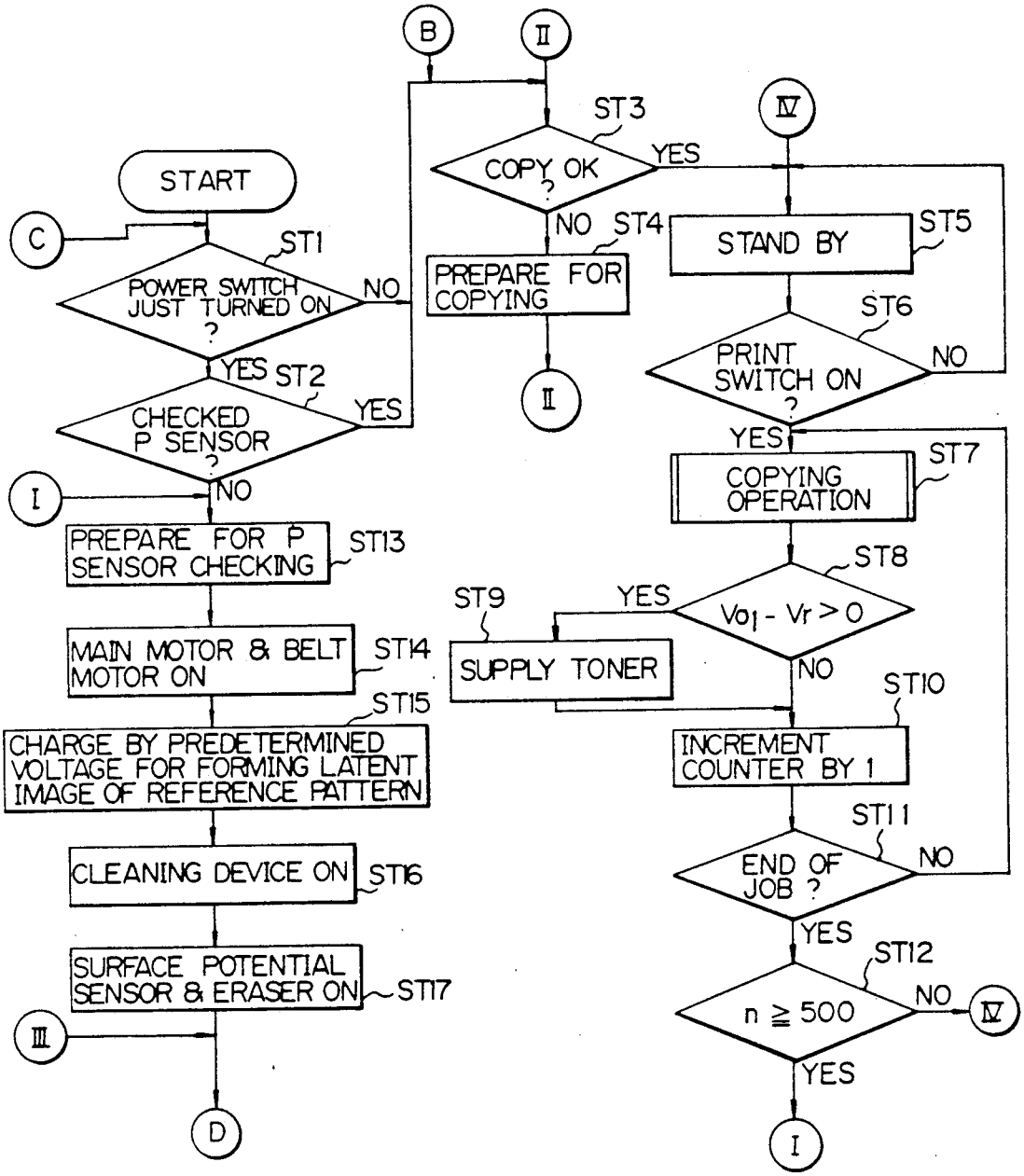
FIGS. 4A and 4B are flowcharts demonstrating a specific image density control procedure.
Figure 4B:
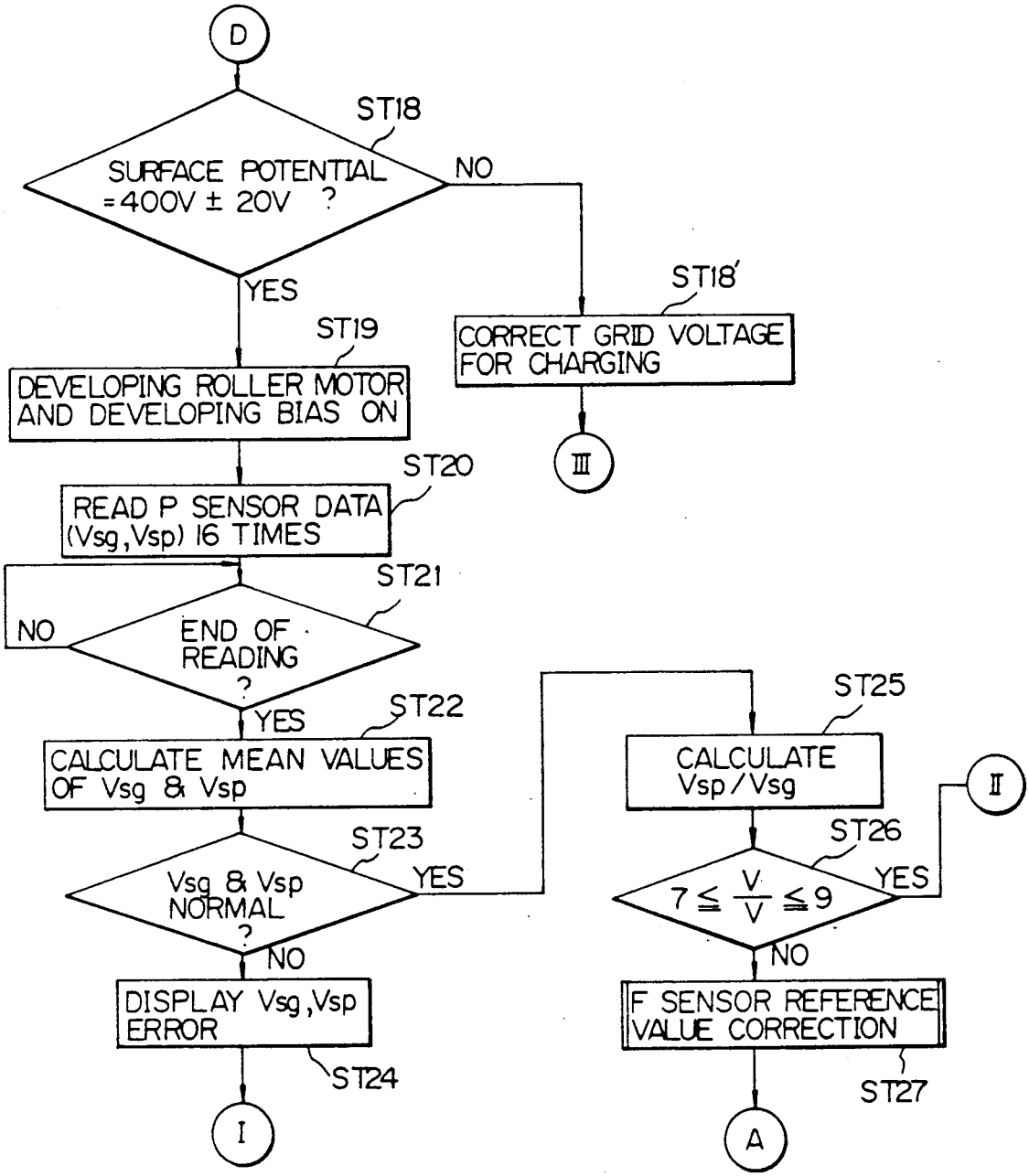

As shown in FIGS. 4A and 4B, when the power switch of the copier is turned on, whether or not the power switch has just been turned on at an operating section the copier body is determined (step ST1). If the answer of the step ST1 is YES, whether or not the function of the P sensor 20 has been checked is determined (step ST2). If the answer of the step ST1 is NO, whether or not a copying operation can be effected is determined (step ST3). If the answer of the step ST3 is NO, predetermined preparations for a copying operation are effected (step ST4) and whether or not a copying operation can be effected is determined again (step ST3). If the answer of the step ST3 is YES, a stand-by state is set up (step ST5) and whether or not a print switch has been turned on is determined (step ST6). If the answer of the step ST6 is YES, a copying operation is started. A counter for counting the copying cycles is updated every time one copy is produced, whether or not a predetermined number of copying cycles (e.g. 500 copying cycles) have been completed is determined, and whether or not the counted number is coincident with a particular number at which an image density detecting procedure which will be described can be commenced (steps ST5 to ST10). If such a number of copying cycles has been reached, the operation is transferred to a step ST13 for preparing for the checking of the P sensor 20. While the copying operation is under way, the toner is supplied on the basis of the result of comparison of an output Vr of the F sensor 21 representative of the sensed density of the developer or toner and a second reference level $V_{02}$ which will be described. This maintains the developer density substantially constant and thereby controls the image density (steps ST8 to ST9).

If the answer of the step ST2 is NO, the preparations for checking the P sensor 20 are effected and a main motor and a motor for driving the belt 9 are energized (steps ST13 and ST14). As the belt 9 starts moving, the charger 10 charges the belt 9 by a predetermined potential for forming a latent image of the reference density pattern (step ST15). At the same time, the cleaning device starts on a cleaning operation (step ST16). Further, the potential sensor 12 starts sensing the surface potential of the belt 9 while the eraser 13 is caused into an operable state, whereby the potential of the latent image of the reference density pattern is detected and the area of the belt 9 other than the area where such a latent image is formed is erased (step ST17). Whether or not the potential of the latent image of the reference density pattern detected by the potential sensor 12 in the step ST17 is equal to a predetermined potential is determined (step ST18). If the answer of the step ST18 is NO, the eraser 5 is turned on to erase the potential, the grid voltage of the charger 10 is changed, an then the program returns to the step ST18 (step ST18').

If the answer of the step ST18 is YES, the grid voltage of the charger 10 is fixed and the eraser 13 is turned on, then turned off and then turned on again. By such a procedure, the latent image of the reference density pattern is provided with a predetermined width. Subsequently, the developing device 15 is driven to apply a developing bias with the result that the developer is deposited on the latent image of the reference density pattern (step ST19). The P sensor 20 produces outputs Vsg and Vsp respectively representative of the reflectances of the white and black portions, i.e., the portions where the developer has not been deposited (background) and where it has been deposited. The controller 22 fetches the output data Vsg and Vsp of the P sensor 20 sixteen consecutive times (step ST20). Whether or not such data have been fetched sixteen times is determined (step ST21). If the answer of the step ST21 is YES, mean values of the individual output data Vsg and Vsp are calculated (step ST22). Then, whether or not the calculated mean values each lies in a predetermined normal range is determined (step ST23). If the answer of the step ST23 is NO, the error of the data Vsg and Vsp is displayed (step ST24) and the program returns to the step ST13.

Figure 6:
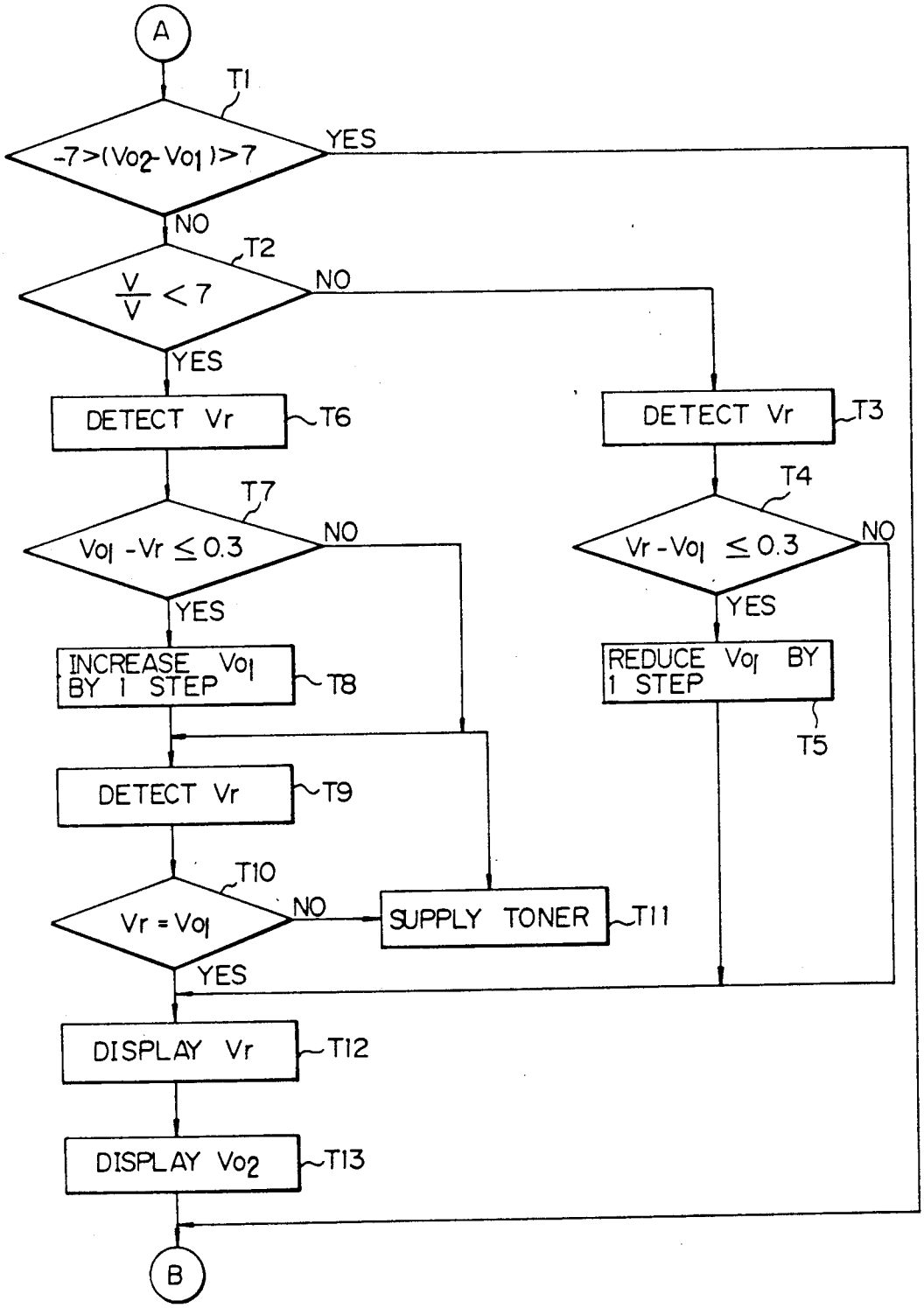
FIG. 6 is a flowchart demonstrating the changeover of a first reference level effected in response to an output of an image density sensor or P sensor, together with toner concentration control associated therewith.

If the answer of the step ST23 is YES, the ratio of the output data Vsg to the output data Vsp, i.e., Vsg/Vsp is calculated (step ST25). Then, whether or not the resulted ratio Vsg/Vsp lies in a predetermined range is determined (step ST26). If the answer of the step ST26 is NO, a step ST27 is executed for correcting the reference level (reference value) of the F sensor 21. Then, the program advances to reference level correction and developer density control as shown in FIG. 6. If the answer of the step ST25 is YES, the image density is determined to be adequate and the operation is transferred to the step ST3.

The initial reference level of the F sensor 21 is set before the control procedure described above with reference to FIGS. 4A and 4B begins, e.g., before shipment from a factory, at the time of maintenance, in the event of replacement of the whole developer, or every time a predetermined number of copying cycles have been completed. How the reference level of the F sensor 21 is set will be described hereinafter.

Specifically, in the illustrative embodiment, the F sensor 21 responsive to the toner concentration of the developer has two different reference levels, i.e., a first reference level which is variable in response to the output of the P sensor 20 reference level which is fixed machine by machine. During usual image density control, the output level of particular means for producing an output representative of the toner concentration of the developer in response to the output of the F sensor 21 is compared with the first reference level. Based on the result of such comparison, the toner supply is controlled to maintain the toner concentration and, therefore, the image density constant.

Figure 5:
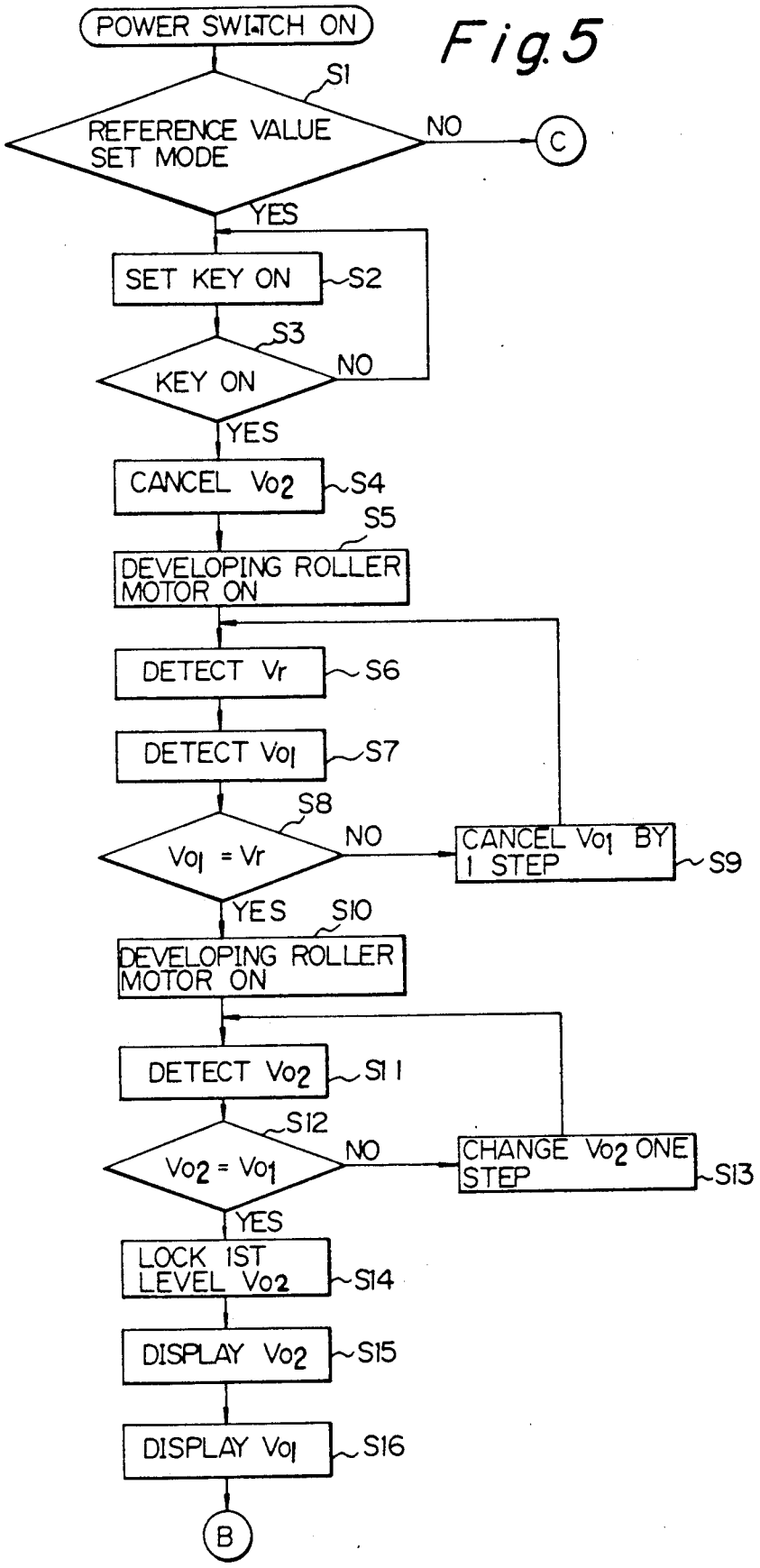
FIG. 5 is a flowchart showing a procedure for setting a second reference level assigned to a toner density sensor or F sensor.

FIG. 5 demonstrates a procedure for setting the second reference level $V_{02}$ by an exclusive setting key in matching relation to the conditions of the developer and copier, and locking the set second reference level $V_{02}$.

The exclusive key for setting the second reference level (reference value) $V_{02}$ may be operated after the power switch of the copier has been turned on and before the copier actually starts on a copying procedure. In FIG. 5, whether or not a reference value set mode has been set up is determined (step S1). If the answer of the step S1 is NO, the operation is transferred to the control step ST1 shown in FIGS. 4A and 4B. When the answer of the step S1 is YES, the above-mentioned key is turned on (step S2). Then, the existing set value of the second reference level $V_{02}$ is deleted and the developing roller drive motor is energized (steps S3 to S5). On the turn-on of the developing roller drive motor, the F sensor 21 starts sensing the developer density and produces an output Vr representative of the detected density. The sensor output Vr and the first reference level $V_{01}$ are compared, and the step number of the first reference level $V_{01}$, i.e., the output of the first reference level is changed until they compare equal. (steps S6 to S9). By the steps S6 to S9, a first reference level $V_{01}$ matching the condition of the developer is set up.

After the first reference level $V_{01}$ has been set up as stated above, the developing motor is turned off (S10). Then, the second reference level $V_{02}$ is compared with the first reference level $V_{01}$, and the step number of the second reference level $V_{02}$, i.e., the output of the level $V_{02}$ is changed until the two are equal. As a result, the first and second reference levels $V_{01}$ and $V_{02}$ are controlled to the same value (steps S11 to S13). By the steps S11 to S13, a second reference level $V_{02}$ matching the initial toner density such as the toner density immediately after the replacement of a developer is set up. Subsequently, the set second reference level $V_{02}$ is locked (step S14). The locked second reference level is stored in a storage until the exclusive key has been turned on afterwards. More specifically, the locked value of the second reference level $V_{02}$ is set on the basis of the instantaneous conditions of the developer and others when the key is turned on. For this reason, this key may advantageously be used at the time of shipment, maintenance, and the supply of a fresh developer and replacement thereof. When the second reference level $V_{02}$ is set again on such an adequate occasion, it obtains a value associated with the initial developer density which is optimum. Therefore, the image density is controlled on the basis of the set second reference level $V_{02}$. After the second reference level $V_{02}$ has been set up as described above, the control advances to the step ST3 shown in FIG. 4A. The steps S15 and S16 shown in FIG. 5 are not essential. Nevertheless, displaying the first and second levels $V_{01}$ and $V_{02}$ after the second level $V_{02}$ has been locked will readily show a person the time of replacement and that of maintenance and thereby promote easy management of the copier.

Referring to FIG. 6, the operation for correcting the first reference level of the F sensor 21 and controlling the toner supply in response to the output of the P sensor 20 (step ST 27, FIG. 4B) will be described. As shown, whether or not the difference between the second and first reference levels $V_{01}$ and $V_{01}$ lies in a predetermined range (e.g. $\pm 7$ volts) is determined (step T1). If the answer of the step T1 is NO, the program returns to the step ST3 of FIG. 4A without changing the first reference level $V_{01}$ by determining that the state is unusual. If the answer of the step T1 is YES, whether or not the ratio of the reflectance of the portion of the reference density pattern where the developer has not been deposited to the reflectance of the other portion of the same pattern where it has been deposited (Vsg/Vsp) is smaller than a predetermined value (e.g. "7") is determined (T2). If the answer of the step S2 is NO, the instantaneous output Vr of the F sensor 21 is detected (T3) and compared with the instantaneous first reference level $V_{01}$ (T4). Then, whether or not the difference between Vr and $V_{01}$ ($Vr-V_{01}$) is equal to or smaller than a predetermined value such as "0.3 volt" (step T4) is determined. It is to be noted that 0.3 volt mentioned is only illustrative and may be replaced with any other suitable value so long as it is little susceptible to sharp changes in toner density. If the answer of the step T4 is NO, the changeover of the reference level $V_{01}$ responsive to the output of the P sensor 20 is interrupted, the current values Vr and $V_{01}$ are displayed (steps T12 and T13), and the program returns to the step ST3 of FIG. 4A.

If the answer of the step T4 is YES, the first reference level $V_{01}$ of the F sensor 21 is lowered by one step (step T5), the output Vr of the F sensor 21 and the first reference level $V_{01}$ are displayed (steps T12 and T13), and the control returns to the step ST3 of FIG. 4A. Specifically, when the detected ratio Vsg/Vsp is great, meaning that the toner concentration of the developer is excessively high, the program returns to the copying operation simply after correcting the first reference level $V_{01}$ and without supplying any toner. If the answer of the step T2 is YES, the current output Vr of the F sensor 21 is detected (step T6). Then, whether or not the difference between the detected sensor output Vr and the first reference level $V_{01}$ is equal to or smaller than a predetermined value is determined (step T7). If the answer of the step T7 is NO, the changeover of the first reference level $V_{01}$ responsive to the output of the P sensor 20 is interrupted, the toner is supplied by steps T9 to T11 on the basis of the current second reference level $V_{01}$, and then the current values of Vr and $V_{01}$ are displayed (steps T12 and T13). This is followed by the step ST3 shown in FIG. 4A. If the answer of the step T7 is YES, the first reference level $V_{01}$ of the F sensor 21 is raised by on step (step T8). Then, the toner is supplied until the output Vr coincides with the first reference level $V_{01}$ and, on coincidence, the toner supply is interrupted (steps T8 to T11). Subsequently, the output Vr of the F sensor 21 and the first reference level $V_{01}$ are displayed (steps T12 and T13), followed by the step ST3 of FIG. 4A.

As stated above, in the illustrative embodiment, the F sensor 21 is provided with the second reference level $V_{01}$ representative of the state associated with the optimum condition of a developer (e.g. immediately after the replacement thereof), and the first reference level $V_{01}$ variable in response to the output of the P sensor 20. During usual control, the toner concentration of the developer is detected on the basis of the output of the F sensor 21, and the toner supply to the developer is controlled on the basis of the result of comparison of the detected toner concentration Vr and the first reference level $V_{01}$. This is successful in maintaining the toner concentration of the developer substantially constant while promoting adequate management of the developer and sure image density control.

The illustrative embodiment assigns a certain range to the results of comparison of the first and second reference levels $V_{01}$ and $V_{02}$, as stated earlier. When the result of comparison does not lie in the predetermined range, the existing state is maintaned. Hence, excessive or short supply of toner is eliminated even when the P sensor 20 or the F sensor 21 fails.

Further, assume that the toner concentration of the developer has changed temporarily due to a sharp change in temperature, humidity or similar ambient condition or due to the manner of use, so that the difference between the output Vr of the F sensor 21 and the first reference level $V_{01}$ has exceeded the predetermined value. Then, the first reference level $V_{01}$ is prevented from being changed despite the output of the P sensor 20. This is also successful in eliminating excessive or short supply of toner.

While the display of the output Vr of the F sensor 21 and the first reference level $V_{01}$ shown in FIGS. 5 and 6 are not essential, it will allow a person to easily see the variation in the density of the developer and will thereby facilitate the management of the developer. In this connection, how the output Vr of the F sensor 21 and the first and second reference levels $V_{01}$ and $V_{02}$ may be displayed will be described hereinafter.

Specifically, the output Vr of the F sensor 21 and the reference levels $V_{01}$ and $V_{02}$ each is displayed at the particular timing shown in FIG. 5 or 6 and is maintained until the next display timing. The output Vr of the F sensor 21 is displayed in voltage. Hence, by using "10 V/255" as a unit, it may be displayed as "6.50", for example, which is an integral multiple of the unit. The reference levels $V_{01}$ and $V_{02}$ of the F sensor 21, like the sensor output Vr, use "10 V/255" as a unit by way of example, but they are displayed in triple integral multiple by taking account of the relation of the sensor output Vr to the toner density. Referring again to FIG. 5, assuming that the output Vr of the F sensor is 6.5098 volts when the exclusive setting key is turned on, then the first reference level $V_{02}$ is determined to be coincident with the voltage Vr when it is 6.4705 volts which is closest to 6.5098 volts. Hence, the first reference level is changed by each 0.1176 volt, i.e., 0.1176 volt per step. This is also true with the second reference level $V_{02}$. Therefore, the sensor output Vr is displayed as "650 V" while the first and second reference levels $V_{01}$ and $V_{02}$ each is displayed as "6.47 V". More specifically, the sensor output Vr and the reference levels $V_{01}$ and $V_{02}$ are fully end and regarded to be equal with a difference less than about $\pm 0.04$ volt being adopted.

While the display in the control procedure shown in FIG. 6 is executed by a similar process, the control is so effected as to cause the sensor output Vr to follow the first reference level $V_{01}$ in response to the supply of toner. In this case, therefore, the display of the sensor output Vr, like the display of the reference levels $V_{01}$ and $V_{02}$, is controlled on the basis of the integral multiple of "10 V/255×3" and is displayed in integral multiple also.

Usually, the output Vr of the F sensor 21 and the first and second reference levels $V_{01}$ and $V_{02}$ are displayed on the same screen so that a person may see them easily. This facilitates the decision on the time for toner replacement, the time for maintenance, etc.

In summary, in accordance with the present invention, an F sensor is provided with a second reference level representative of a state associated with the optimum condition of a developer (e.g. immediately after the replacement thereof), and a first reference level variable in response to the output of a P sensor. During usual control, the toner concentration of the developer is detected on the basis of the output of the F sensor, and the toner supply to the developer is controlled on the basis of the result of comparison of the detected toner concentration and the first reference level. This is successful in maintaining the toner concentration of the developer substantially constant while promoting adequate management of the developer and sure image density control.

The present invention assigns a certain range to the results of comparison of the first and second reference levels. When the result of comparison does not lie in the predetermined range, the existing state is maintained. Hence, excessive or short supply of toner and, therefore, a sharp change in the reproduction quality is eliminated even when the P sensor or the F sensor fails.

Further, assume that the toner concentration of the developer has changed temporarily due to a sharp change in temperature, humidity or similar ambient condition or due to the manner of use, so that the difference between the output of the F sensor and the first reference level has exceeded the predetermined value. Then, the first reference level is prevented from being changed despite the output of the P sensor. This is also successful in eliminating excessive supply of toner which would cause the toner to scatter around and the image quality to noticeably change or short supply of toner which would damage a photoconductive element and the developer. Hence, a stable image quality is insured.

In addition, since the second reference level is representative of a state associated with the optimum condition of the developer as stated above, the variation of the developer due to aging and the failures of the P and F sensors are easily detected by comparing the first and second reference levels. The output of the F sensor and the first and second reference levels may be displayed on an operation panel of an image forming apparatus to allow a person to easily compare such values. This will facilitate the decision on the time for developer replacement, the time for maintenance, and errors.

Various modifications will become possible for those skilled in the art after receiving the teachings of the present disclosure without departing from the scope thereof.

What is claimed is:

1. An image density control method for an electrophotographic image forming apparatus which forms a predetermined image on a medium by electrostatically forming a latent image on a photoconductive element, electrostatically depositing a toner contained in a developer on said latent image to produce a toner image, and transferring said toner image to said medium, comprising the steps of:

sensing, by a photosensor, a toner image produced by developing a latent image of a reference density pattern formed on the photoconductive element;

sensing a toner concentration of the developer by a toner density sensor;

storing in first storing means a first reference level which is to be compared with an output of said toner density sensor for controlling supply of the toner;

storing in second storing means a second reference level which is to be compared with said first reference level; and setting, in a reference level set mode, said first and second reference levels in response to an output of said toner density sensor;

said first reference level being rewritable in response to an output of said photosensor, the rewriting of said first reference level in response to an output of said photosensor being limited on the basis of a result of comparison of said first and second reference levels.

2. A method as claimed in claim 1, wherein in said reference level set mode said first reference level is set in response to an output of said toner density sensor, and then said second reference level is set in response to said first reference level.

3. A method as claimed in claim 2, wherein in said reference level set mode an output of said toner density sensor is set as said first and second reference levels.

4. A method as claimed in claim 3, wherein the rewriting of said first reference level is limited when a difference between said first and second reference levels exceeds a predetermined value.

5. A method as claimed in claim 4, wherein said first and second reference levels are displayed.

* * * * *